US005692425A

United States Patent [19]

Sterling

[11] Patent Number: 5,692,425

[45] Date of Patent: Dec. 2, 1997

[54] PROTECTIVE DEVICE FOR SAW OPERATORS

[76] Inventor: Michael Sterling, 15176 Lipson, Visalia, Calif. 93292

[21] Appl. No.: 600,393

[22] Filed: Feb. 12, 1996

[51] Int. Cl.[6] ..... B27B 25/10

[52] U.S. Cl. ..... 83/437.2; 83/425; 83/435.15; 83/438; 83/477.2

[58] Field of Search ..... 83/425, 437.2, 83/438, 477.2, 435.15

[56] References Cited

U.S. PATENT DOCUMENTS

| | | | |
|---|---|---|---|
| 2,696,852 | 12/1954 | Dunton | 83/435.15 |
| 3,848,502 | 11/1974 | O'Neil . | |
| 4,026,173 | 5/1977 | Livick . | |
| 4,399,728 | 8/1983 | Davis . | |
| 4,485,711 | 12/1984 | Schnell | 83/425 |
| 4,603,612 | 8/1986 | Atkins . | |
| 4,719,951 | 1/1988 | Woltanski | 83/438 |
| 5,016,509 | 5/1991 | Stottman | 83/425 |
| 5,341,711 | 8/1994 | Stay, Jr. et al. | 83/438 |

*Primary Examiner*—Eugenia Jones
*Assistant Examiner*—Charles Goodman
*Attorney, Agent, or Firm*—Paul F. Schenck

[57] ABSTRACT

The protective push stick includes a transparent cover extending over the saw blade of a table saw to protect the operator's hand from the saw blade and to protect the operator's eye from particles flying upwards from the saw blade.

10 Claims, 4 Drawing Sheets

PROTECTIVE DEVICE FOR SAW OPERATORS

BACKGROUND OF THE INVENTION

Operators of circular saws are always reminded to make use of protective devices such as protective eye glasses and face shields, and to be careful when pushing a work piece towards the rotating saw blade. Many different devices are provided to reduce the danger of injury to the hand of the operator. Some table saws have protective covers over the saw blade. The protective cover is lifted by the work piece during the cutting operation. Thus, the cover leaves only a space open which is equivalent to the thickness of the work piece. Still, with a thick work piece that space can be large enough to allow injury to the hand of the operator. Other protective devices include electronic means which trigger a brake and stop the saw blade if the hand comes close to the saw blade. These protective devices include gloves including conductive layers worn by the operator and connected to some electronic sensor which recognizes when a conductive layer makes contact with the saw blade. Such devices are proposed for the meat cutting industry. Still other means include just a stick for pushing the work piece towards the saw blade. All these types of devices have in common to protect the hand of the operator.

The push stick of the present invention provides protection for the hand of the operator as well as additional eye and face protection.

OBJECT OF THE INVENTION

It is an object of the invention to provide protection for the hand of a table saw operator.

It is another object of the invention to provide additional eye and face protection for the operator of a table saw.

It is another object of this invention to provide for easy and safe operation of the present invention.

It is still another object of this invention to remind the operator of a table saw to make use of the present invention.

It is still another object of the invention to adapt the present invention to particular work conditions.

SHORT DESCRIPTION OF THE INVENTION

The present invention is a push stick for pushing a work piece towards and past the rotating saw blade of a table saw, past the bit of a table router or any other type of table tool. The main body of the push stick includes a handle with which the operator controls movement of the push stick, and a recess with Which the push stick is held against a work piece. Attached to the main body is a transparent shield which covers the rotating Saw blade or router bit and deflects particles cut by the tool or moved by rushing air from flying towards the operator's head. The interchangeable shield provides for the adaptation to different work conditions and different types of machines. The thickness of the main body of the push stick is selected so that the push stick may be inserted into a miter gauge rail of the table saw, table router or the like.

DETAILED DESCRIPTION OF THE INVENTION

Figures 1A, 1B:
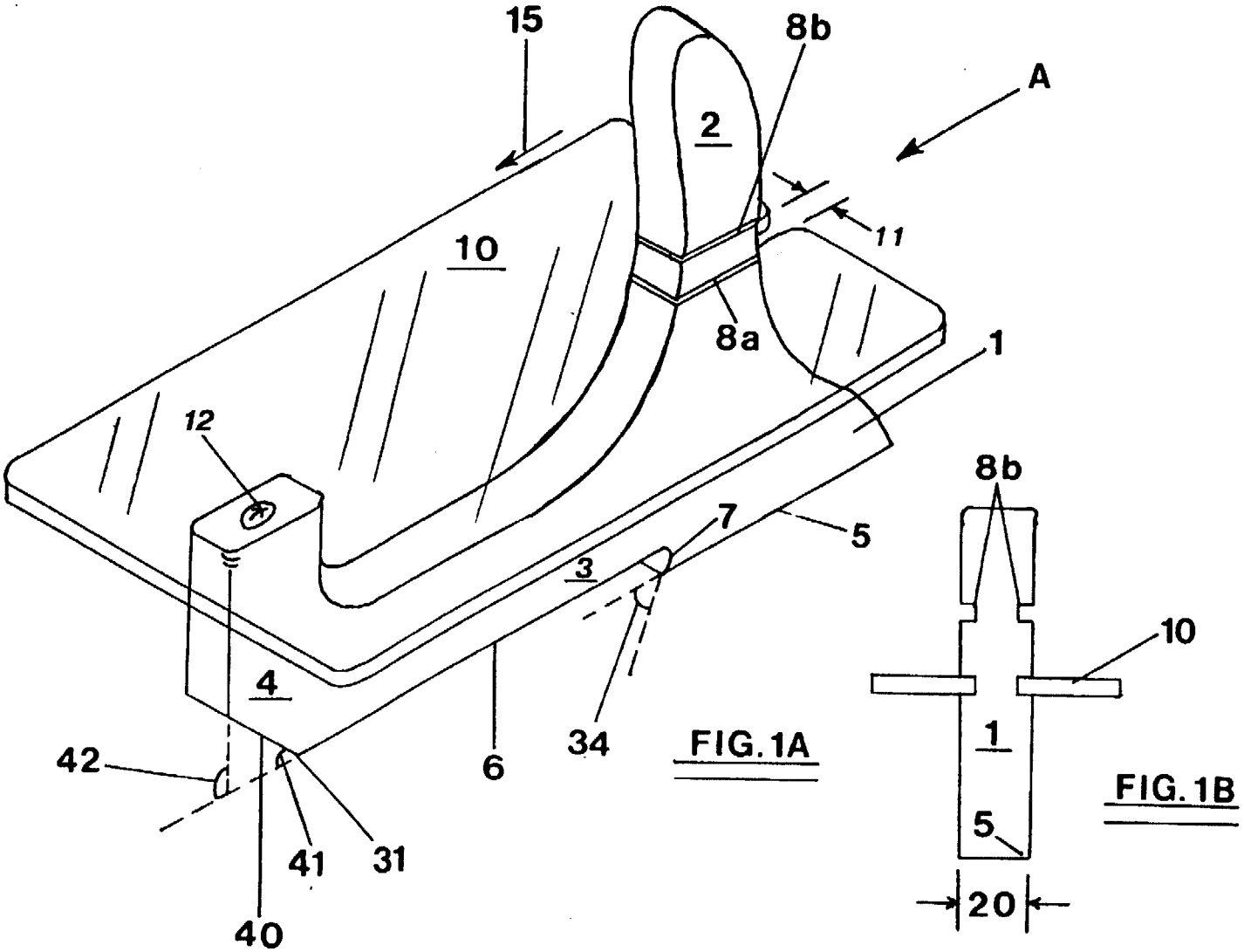
FIG. 1A is a perspective illustration of the present invention.
FIG. 1B is a rear view illustration of the push stick as indicated by arrow "A" in FIG. 1A.

FIG. 1A is a perspective illustration of the push stick of the present invention. The main body 1 of the push stick includes a handle section 2, a bottom section 3, and a shield support 4. Bottom section 3 includes a foot section 5 and a work piece interface section 6, connected by a step 7. Shield support 4 and slot 8*a* in handle section 2 determine the position of shield 10. Shield 10 includes a slot 11 which fits into slot 8*a* and secures shield 10 at handle section 2. A screw 12 attaches shield 10 to shield support 4. Removing shield 10 is done by loosening screw 12 and pushing shield 10 out of slot 8*a* in the direction indicated by arrow 15. Installing a shield 10 is easily done in the opposite sequence. Thus, it is easy to exchange one type of shield 10 with another type shield 10.

In a practical application push stick 1 is placed with work piece interface section 6 on a work piece 30. Step 7 is pushed against the edge of the work piece. Step 7 should preferably be lower or smaller than the thickness of the work piece 30 to ensure proper rest of interface section 6 on work piece 30. Proper rest reduces the possibility that the work piece vibrates during the sawing operation. However, if work piece 30 is thicker than step 7 is high then the push stick still provides safe operation because front end edge 31 is pushed downwards onto workpiece 30, thereby safely holding workpiece 30 on the table. To safely accommodate workpieces thicker than the height of step 7 step 7 may be sightly angled (angle 34) as shown in FIG. 1A.

Figure 3A:
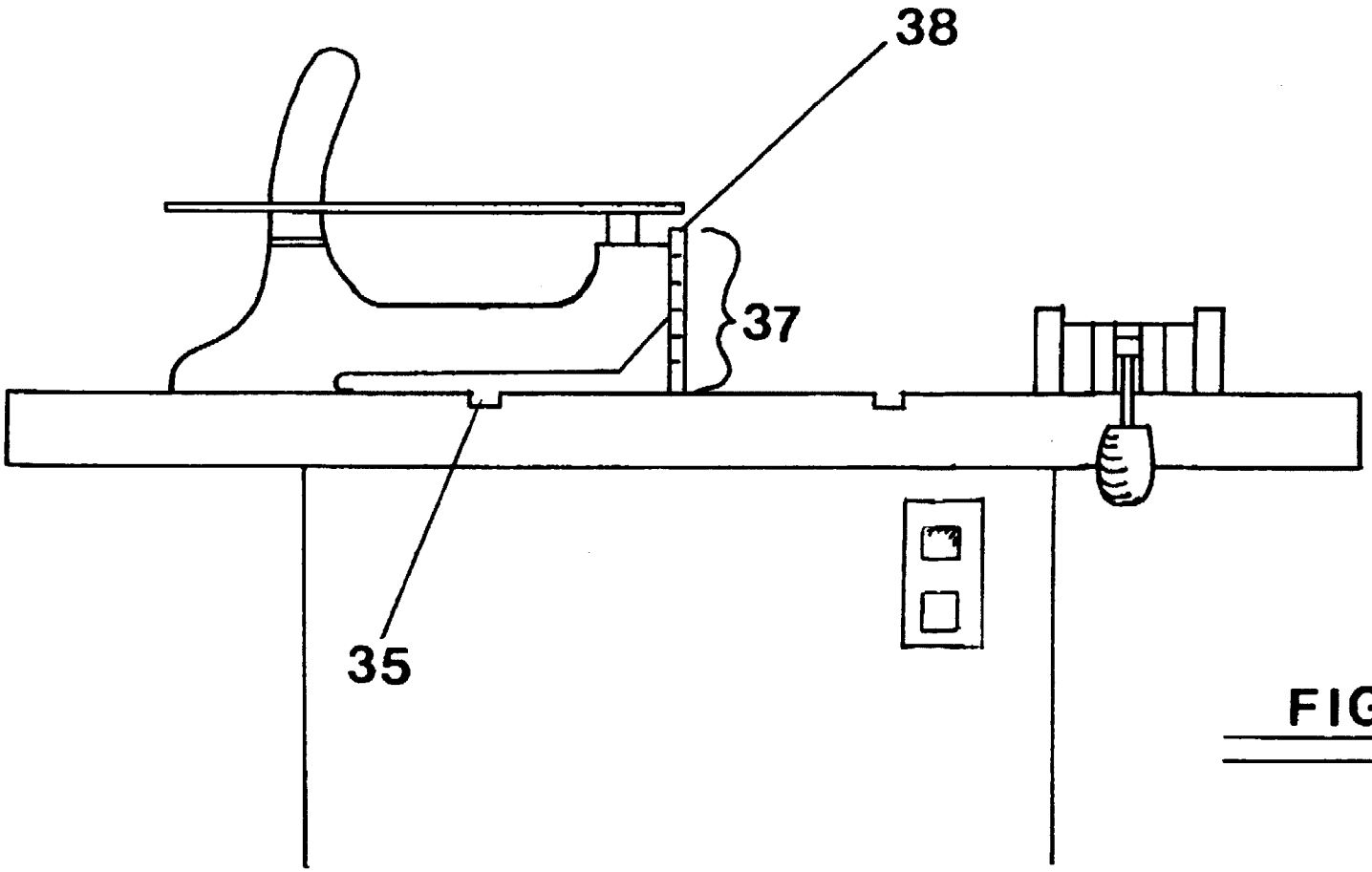
FIGS. 3A and 3B are illustrations of the push stick during setting of a saw blade angle using the angled front end surface faces.

The thickness 20 of foot section 5 should be sightly smaller than miter gauge slot 35 of table saw 36 (see FIG. 3A), so that push stick 1 can be placed in upright position in such a slot when not in use. This serves to remind the operator to make use of the push stick when cutting a work piece.

Figure 2:
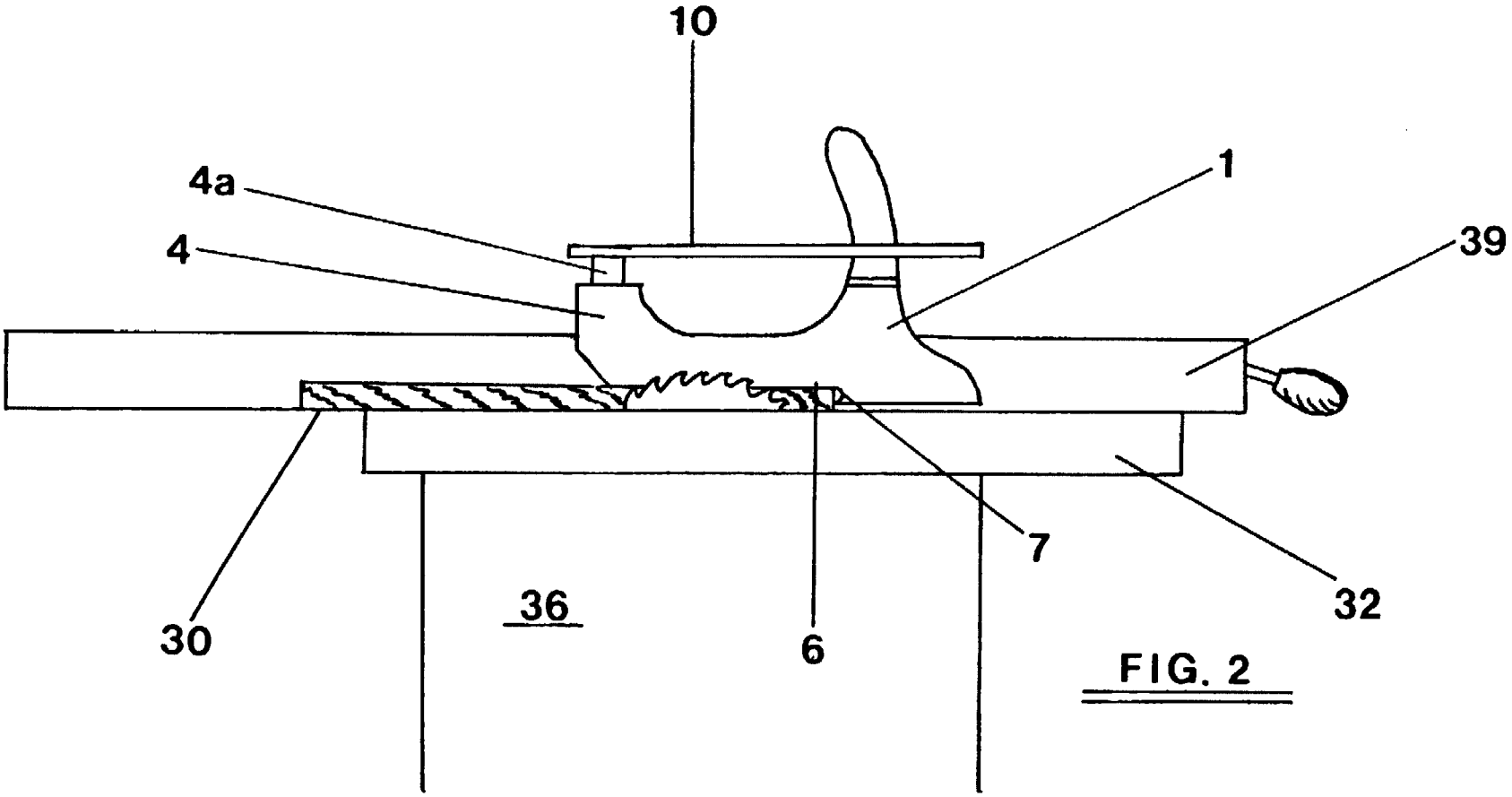
FIG. 2 is an illustration of the push stick of the present invention when used in combination with a table saw.

The height of shield 10 above foot 5 should be larger than the working height 37 of saw blade 38 protruding through table 32, so that the hand holding handle 2 remains safely and covered above the saw blade. For narrow cuts the height of shield 10 should also exceed the height of fence 39 of table saw 36. To accommodate these conditions the mounting height of the shield 10 above the the work piece interface section 6 could be made adjustable as shown in FIGS. 1B and 2, using second slot 8*b* in handle section 2 and a shield support extender 4*a*. The width as well as the length of shield 10 should be sufficient to deflect all particles accelerated by the saw blade action or air flow from flying towards the operator's face.

The position of handle 2 should be over foot section 5 but close to step 7 to ensure proper operation, e.g. safely engage step 7 with the work piece, and providing a downward force with the front end of work piece interface section 6 onto the work piece.

While the push stick of FIG. 1A has only a simple plain shield 10 other shapes can be used to adapt the push stick to special applications. For easy exchange of different types of shields 10 screw 12 can be replaced by a quick connect fastener or the like.

Other areas of application of push stick 1 are router tables, shapers during operation without blade/bit coverage and face planing using a jointer.

Figure 3B:
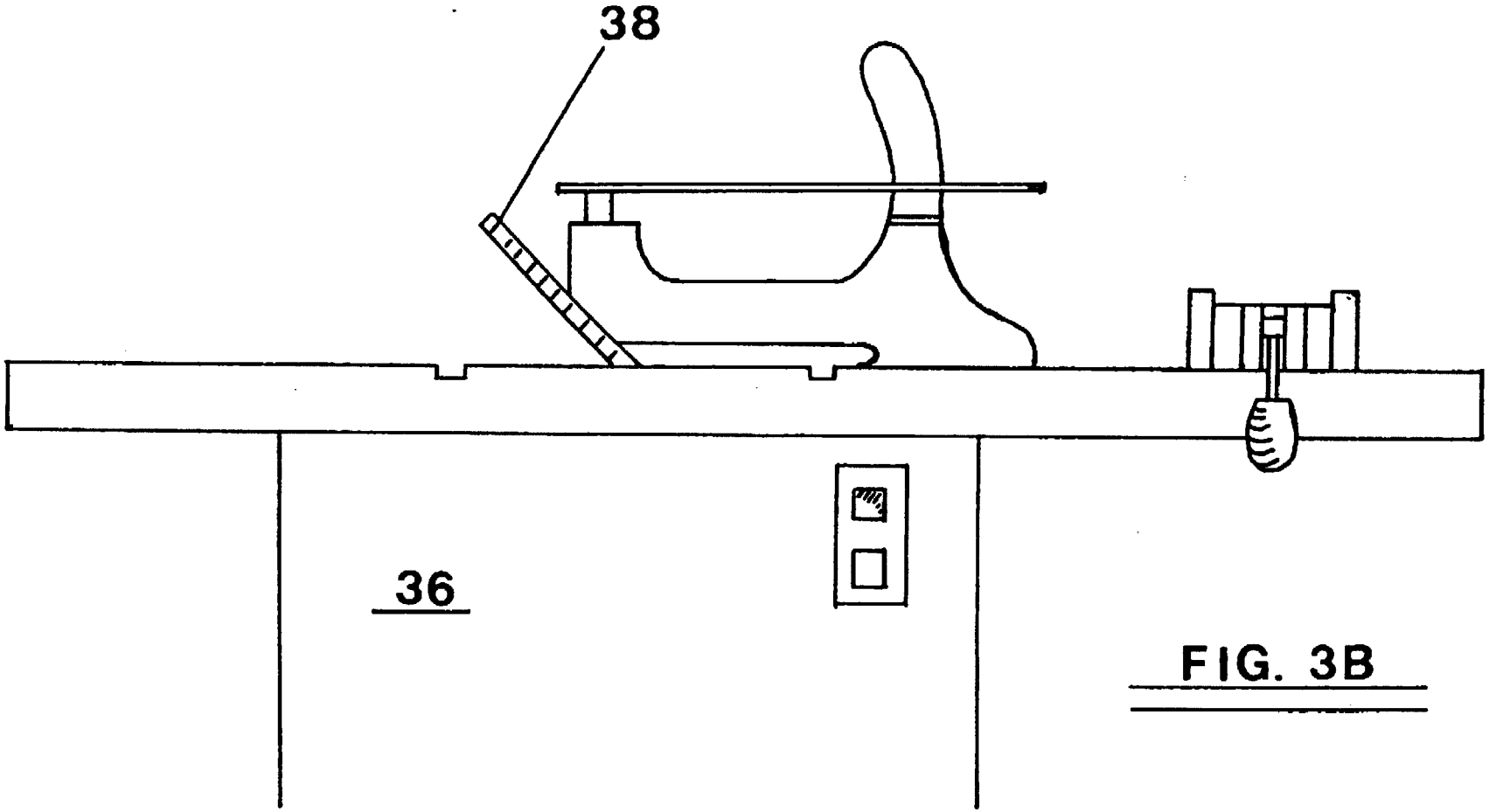

The push stick of the present invention may have an angled cut-off at shield support 4. The angled front end 40 may be used to check often used angular settings of the tool, such as angular setting at setting of a saw blade 38 at 90° (see FIG. 3A) or at 45° (see FIG. 3B). A 45° angle 41 and a 90° angle 42 are shown in FIG. 1A. Other cuts and engraved markings may be provided with or added to the push stick to simplify adjustment and/or checking tool height, tool width etc.

What I claim is:

1. A push stick for advancing a work piece having a minimum thickness on a table of a table saw during a cutting operation, said table saw including a saw blade and a rip fence, said push stick comprising a main body, and a protective shield extending on both sides of said main body and having a width to extend on one of said sides of the main body over the rip fence and on another side of said sides over the saw blade of said table saw;

said main body having a top section and a bottom section;

said top section including a handle, and means for securing said protective shield to said main body;

said bottom section including a first flat surface and a second flat surface, said first and second flat surfaces being connected by a step surface, said second flat surface having a width smaller than a miter gauge slot width of said table saw, said step surface having a height between said first and said second flat surfaces, said height determining said minimum thickness of said work piece being cut; said means for securing said protective shield including a guiding slot in said handle and a support post at a forward end of said push stick, said protective shield being transparent and having a gap slot for securing one end of said protective shield in said guiding slot, said protective shield being fastened to said support post at a second end;

whereby said first flat surface provides a downward pressure on said work piece, and whereby said step surface pushes said work piece forward while said push stick is moved by said handle in forward direction.

2. A push stick as claimed in claim 1, wherein said protective shield is higher than a portion of said saw blade extending above said table.

3. A push stick as claimed in claim 2, wherein said height of said protective shield is adjustable.

4. A push stick as claimed in claim 1, wherein said protective shield has a width sufficient to cover a portion of said saw blade extending above said table saw.

5. A push stick as claimed in claim 1, wherein said protective shield has a length sufficient to cover said saw blade of said table saw during said cutting operation.

6. A push stick as claimed in claim 1, wherein said protective shield has a width and a length sufficient to cover said saw blade of said table saw during said cutting operation.

7. A push stick as claimed in claim 1, further including a front end section including reference means for setting said saw blade of said table saw selectively at a first or a second angle relative to said table, wherein said first and said second angles are 90° or less, said front end section having a first surface face angled at said first angle and at least a second surface face angled at said second angle.

8. A push stick as claimed in claim 7, wherein said first angle is 90°, and wherein said second angle is 45°.

9. A push stick as claimed in claim 1, wherein said step surface is substantially normal to said first and second flat surfaces.

10. A push stick as claimed in claim 1, wherein said step surface intersects said first and said second flat surfaces at angles less than 90 degree.

* * * * *